US007311074B2

(12) United States Patent
Sailer et al.

(10) Patent No.: US 7,311,074 B2
(45) Date of Patent: Dec. 25, 2007

(54) GUIDE RAIL FOR VALVE TAPPET OF AN INTERNAL COMBUSTION ENGINE

(75) Inventors: Peter Sailer, Erlangen (DE); Oliver Schnell, Veitsbronn (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/505,587

(22) Filed: Aug. 17, 2006

(65) Prior Publication Data

US 2007/0039575 A1 Feb. 22, 2007

Related U.S. Application Data

(60) Provisional application No. 60/708,986, filed on Aug. 17, 2005.

(51) Int. Cl.
*F01L 1/14* (2006.01)

(52) U.S. Cl. ..... 123/90.5; 123/90.48

(58) Field of Classification Search ..... 123/90.48, 123/90.5, 90.51

See application file for complete search history.

(56) References Cited

U.S. PATENT DOCUMENTS 5,263,386 A 11/1993 Campbell et al.
7,086,360 B1 * 8/2006 Schnell et al. ..... 123/90.5
2004/0065282 A1 4/2004 Riley

FOREIGN PATENT DOCUMENTS

DE 10163411 7/2003

* cited by examiner

*Primary Examiner*—Ching Chang
(74) *Attorney, Agent, or Firm*—Volpe and Koenig, P.C.

(57) ABSTRACT

A guide rail (1, 22) for valve tappets (2) of an internal combustion engine is provided. The guide rail (1, 22) has receptacle spaces (4), which are each used for receiving one of the valve tappets (2) and in which there are flattened sections (6) interacting in a positive-fit connection with key surfaces (7) of the valve tappets (2), such that each of the valve tappets (2) is protected from rotating about its longitudinal axis, with the flattened sections (6) permitting alignment of the valve tappet (2) parallel to the flattened sections (6). Here, the guide rail (1, 22) is formed as a metal carrier (3, 25) and rotational protection elements (8, 9, 23), which are fixed on this carrier, have the flattened sections (6) which also permit alignment of the valve tappet (2) orthogonal to the flattened sections (6), in that each flattened section (6) belonging to one of the receptacle spaces (4) can be displaced relative to the metal carrier (3, 25).

10 Claims, 4 Drawing Sheets

GUIDE RAIL FOR VALVE TAPPET OF AN INTERNAL COMBUSTION ENGINE

CROSS-REFERENCE TO RELATED APPLICATIONS

This application is a non-provisional of U.S. Patent Application No. 60/708,986, filed Aug. 17, 2005, which is incorporated herein by reference as if fully set forth.

FIELD OF THE INVENTION

The invention relates to a guide rail for guiding cylindrical valve tappets of an internal combustion engine. The guide rail is essentially comprised of a metallic material and has receptacle spaces, which are arranged at intervals over its longitudinal extent, which are each used for receiving one of the valve tappets, and in which there are flattened sections, which are spaced apart in parallel and which interact with a positive fit with key surfaces of the valve tappet, such that the valve tappet is secured against twisting about its longitudinal axis. Here, the flattened sections permit the valve tappet to be aligned orthogonal to its longitudinal axis and parallel to the flattened sections.

BACKGROUND OF THE INVENTION

Such a guide rail is used for rotation protection of valve tappets, which are typically embodied as roller tappets of a push rod valve train. Simultaneously, they can be used as installation aids for the valve tappet, in that the guide rail and the valve tappets form one structural unit that is protected from loss during transport and installation, so that several valve tappets can be installed simultaneously into the tappet guides of the internal combustion engine.

From DE 101 63 411 A1, which is considered a class-forming invention, a sheet-metal guide rail emerges, which has an especially flat shape and therefore is superior in terms of overall height in comparison with guide rails made from plastic, which are also disclosed in this publication. Plastic guide rails can indeed be produced economically as one-piece injection-molded parts and are also exceptionally well suited, through their own deformation, for equalizing tolerance-related positional deviations in surfaces that are part of the tappet guide system due to their relatively low material stiffness. These surfaces include the tappet guides, the flattened sections of the guide rail, as well as the key surfaces of the valve tappet. Nevertheless, even this low material stiffness must be compensated by increased dimensional stiffness in the longitudinal direction of the valve tappet, so that the overall height of such guide rails can exceed the available installation space in modern internal combustion engines with compact constructions.

While the guide rail proposed in the cited publication, which is composed of sheet metal with a flat overall height, exhibits sufficient dimensional stiffness in the longitudinal direction of the valve tappet, disadvantageously it can also deform only slightly orthogonal to its longitudinal extent and to the longitudinal axis of the valve tappet. The cause here is essentially the relatively high material stiffness of the sheet metal in connection with the high geometrical moment of inertia of the guide rail in this direction. The flattened sections extending parallel to the longitudinal extent of this guide rail are indeed wider than the key surfaces of the valve tappet and therefore permit a free alignment of the valve tappet parallel to the flattened sections; however, compensation of tolerance-related positional deviations is made considerably more difficult due to the high dimensional resistance of the guide rail orthogonal to the flattened sections.

In addition, the flattened sections in the receptacle spaces for the valve tappets are embodied very low and are therefore exposed to a considerable risk of wear as metallic surfaces in their function as rotation protection for the valve tappet. Theoretically this risk of wear can be minimized by subjecting the guide rail to a heat treatment for surface hardening of the flattened sections, but this heat treatment can lead to an impermissibly high dimensional deformation of the guide rail. The alignment errors of the flattened sections with reference to the key surfaces of the valve tappet, in association with such dimensional deformation, can then in practice increase the wear susceptibility of the flattened section despite surface hardening, because the valve tappet mounted in the tappet guides become clamped under the application of considerable transverse forces on the key surfaces between the flattened sections due to the high dimensional stiffness of the guide rail. Simultaneously, it has proven to be extraordinarily difficult to keep this dimensional deformation within tolerable limits in the production of the guide rails in a reliable process, so that there is always the risk of an increased rejection rate and consequently higher costs per piece for the guide rail.

SUMMARY OF THE INVENTION

Therefore, the objective of the invention is to construct a guide rail of the type named above, so that the cited disadvantages are solved with simple means. Accordingly, the guide rail should guarantee rotational protection of the valve tappets over the service life of the internal combustion engine for the smallest possible overall height and here should simultaneously compensate for tolerance-related positional deviations, especially of the tappet guides relative to each other, as well as alignment errors of the flattened sections with reference to the key surfaces of the valve tappet installed in the tappet guides also in the orthogonal direction relative to the flattened sections and independent of the orientation of the flattened section relative to the longitudinal extent of the guide rail.

This object is met by the invention. Accordingly, the guide rail should enclose a metal carrier and rotational protection elements, which are fixed in recesses of the metal carrier, which have flattened sections, and which also permit alignment of the valve tappet orthogonal to its longitudinal axis and orthogonal to the flattened sections, in that the flattened sections each belonging to one of the receptacle spaces can be displaced individually or in common orthogonal to the flattened sections relative to the metal carrier.

In this way, the low requirements for installation space of metallic guide rails can be combined advantageously with the properties of plastic rails that compensate for tolerance-related positional deviations. By dividing the different functions of the guide rail to the metal carrier and the rotational protection elements, these components are separated and selectively optimized with reference to different requirements. Thus, on one side, tolerance related positional deviations both of the tappet guides and also of the receptacle spaces can be compensated despite the dimensionally stiff metal carrier, such that the flattened sections displaceable relative to the metal carrier are adapted to the corresponding position of the key surfaces of the valve tappet located in the tappet guide and these can be protected from torsion with low transverse force. On the other side, because the flattened sections are arranged on the rotational protection elements, simultaneously a heat treatment for the metal carrier for the purpose of protecting the flattened sections from wear can be eliminated in favor of a reliable processing production of the metal carrier and thus reduced production costs of the guide rail.

In another construction of the invention, the rotational protection elements should be dimensionally elastic. For free material selection for the rotational protection elements, in this way a holder for the valve tappet in the guide rail can also be realized for forming a structural unit that is protected from loss with simple means. In comparison with the positive-fit axial locking of the valve tappet in the guide rail proposed in the cited state of the art, for this purpose it is proposed that an inner spacing of the flattened sections is dimensioned so that these surround the key surfaces of the associated valve tappet without play. The resulting frictional surfaces between the flattened sections and the key surfaces of the valve tappet prevent, first, the valve tappet from falling out of the guide rail during transport and installation, so that a common insertion of several valve tappets into the tappet guides is enabled for simultaneous installation of the guide rail in the internal combustion engine. Second, the dimensionally elastic rotational protection elements permit a sufficiently exact controlling of these friction forces, such that the friction losses occurring during the operation of the internal combustion engine are at a negligible level.

The displaceability of the flattened sections can be simplified in a preferred improvement of the invention, such that an air gap is formed between the rear sides and the recesses of the metal carrier. Independent of the dimensional elasticity of the rotational protection elements, this air gap can be combined with a rotational protection element, which is mounted floating in the associated recess in the direction orthogonal to the flattened sections. Here, a rotational protection element can be allocated to each of the receptacle spaces. Such a rotational protection element preferably has a frame-like shape and sliding surfaces, which are mounted so that they can move longitudinally from guide surfaces in the recesses of the metal carrier. Here, the guide surfaces and the sliding surfaces extend orthogonal to the flattened sections.

In addition it is provided that the rotational protection elements are composed of glass fiber-reinforced plastic. This material has already been proven multiple times to be a more economical and wear-free contact partner for rotation protected valve tappets. Here, such rotational protection elements can be fixed on the metal carrier as injection-molded parts produced separately from the metal carrier by means of a clamping or snap-on connection. Alternatively, it is also conceivable that the rotational protection elements are injection molded onto the metal carrier in a plastic injection molding method. In the end, this should be produced economically as a stamped part.

BRIEF DESCRIPTION OF THE DRAWINGS

Additional features of the invention emerge from the following description and from the drawings, in which the guide rail according to the invention is shown as an example with reference to variants of the rotational protection elements. Shown, each in perspective view, are.

DETAILED DESCRIPTION OF THE DRAWINGS

Figure 1:
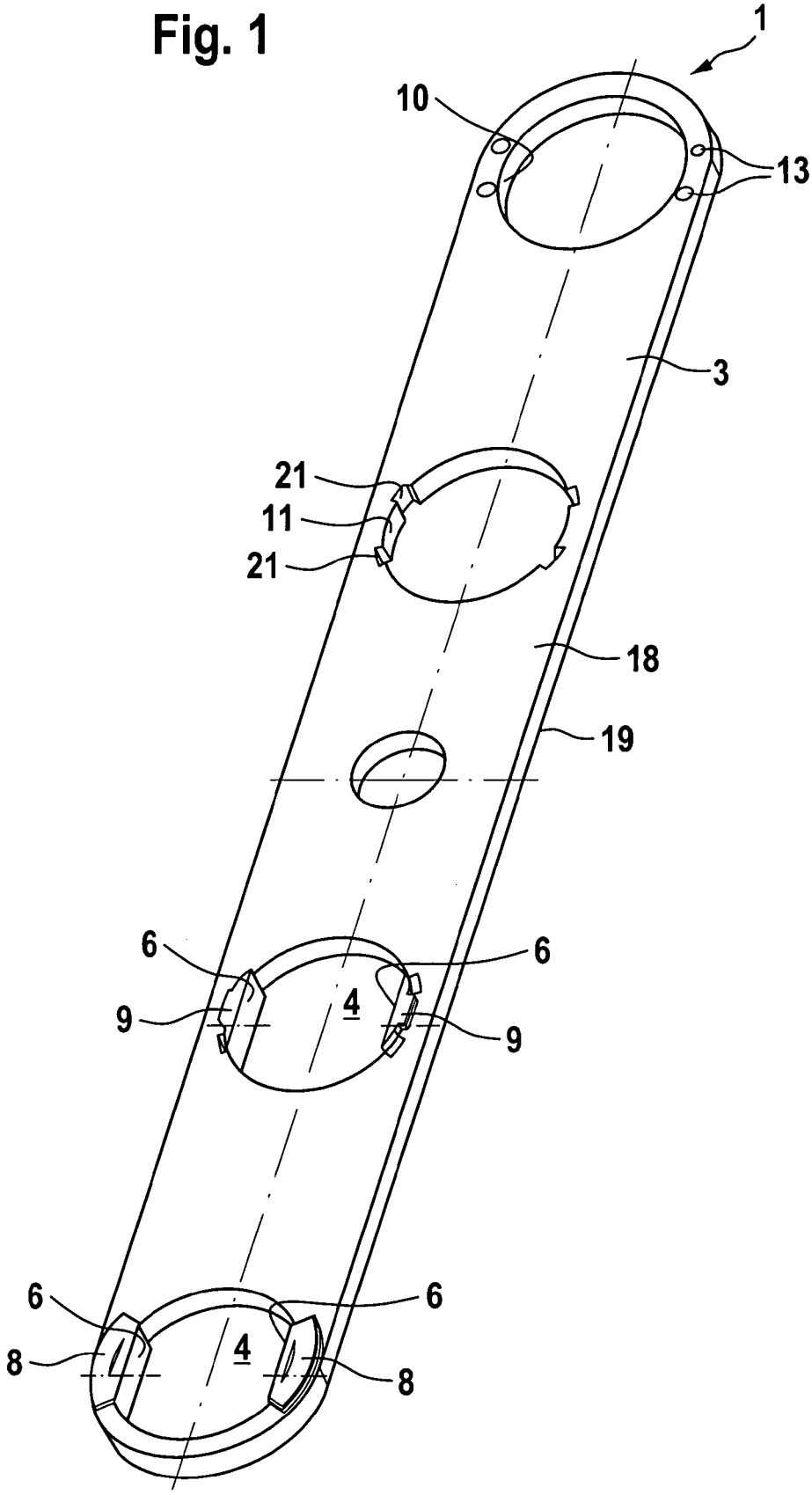
FIG. 1 a guide rail with an injection-molded and clamped rotational protection element made from plastic in an overall view, FIG. 2 the injection-molded rotational protection element from FIG. 1 in an isolated view, FIG. 3 the clamped rotational protection element from FIG. 1 as a detail in an enlarged view, FIG. 4 a valve tappet guided by the guide rail, FIG. 5 a guide rail with a floating rotational protection element in an overall view, FIG. 6 the rotational protection element from FIG. 5 as a detail in an enlarged view, and FIG. 7 the metal carrier from FIG. 5 as a detail view.
Figure 4:
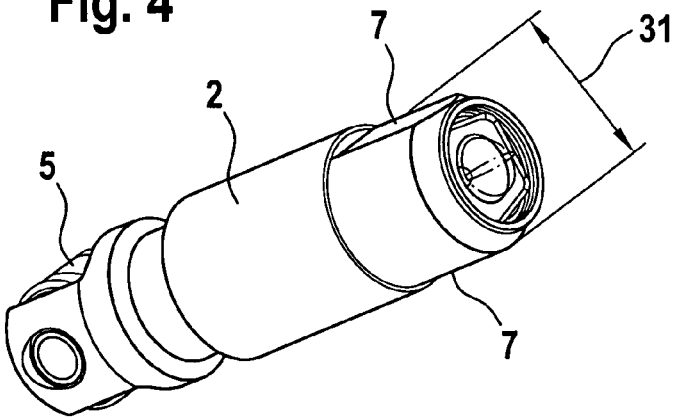

In FIG. 1, a guide rail 1 for guiding cylindrical valve tappets of an internal combustion engine is shown. Such valve tappets designated with 2 in FIG. 4 are typically formed as roller tappets for a push rod valve train with an underlying camshaft, i.e., a camshaft arranged in the crankcase of the internal combustion engine. The guide rail 1 comprises an elongated metal carrier 3 produced as a stamped part and has receptacle spaces 4 arranged at intervals over its longitudinal extent each for receiving one of the valve tappets 2. Because the valve tappets 2 with their rollers 5 as cam pick-up elements are to be protected from rotating about their longitudinal axis, flattened sections 6, which interact with a positive-fit connection to key surfaces 7 of the valve tappet 2, are spaced apart in parallel within the receptacle spaces 4. Accordingly, the valve tappets 2, which can move longitudinally in tappet guides of the internal combustion engine, still have only a translational degree of freedom in the direction of their longitudinal axis, so that the rollers 5 are always directed in parallel to the camshaft.

However, a lifting movement of the valve tappet 2 with as little resistance as possible is to be achieved only by taking into account and compensating to the greatest extent unavoidable component tolerances, which can also lead to alignment errors of the flattened sections 6 in reference to the key surfaces 7 of the valve tappet 2 installed in the tappet guides. In the embodiment, because the flattened sections 6 extending parallel to the longitudinal extent of the guide rail 1 are wider than the key surfaces 7, each valve tappet 2 can be aligned parallel to the longitudinal extent of the guide rail 1 in the rail. The similarly necessary alignment of the valve tappet 2 transverse to the longitudinal extent of the guide rail 1 is enabled in this carrier despite the high dimensional stiffness of the metal carrier 3, such that the flattened sections 6 are formed not directly on the metal carrier 3, but instead on rotational protection elements 8, 9, so that the flattened sections 6 can be displaced relative to the metal carrier 3 transverse to the longitudinal extent of the guide rail 1.

As explained below, the rotational protection elements 8, 9 are formed differently and fixed on the metal carrier 3. In FIG. 1, for limiting the number of figures necessary, a first and a second variant of the rotational protection elements 8, 9 comprising glass fiber-reinforced plastic on the same metal carrier 1 are disclosed. Furthermore, recesses 10, 11 of the metal carrier 3, which correspond to the rotational protection elements 8, 9 and on which the rotational protection elements 8, 9 are fixed, are shown without the rotational protection elements 8, 9. However, for the discussed guide rails, it is obviously useful to embody all of the rotational protection elements of the guide rail, as well as the corresponding recesses, as one unit.

Figure 2:
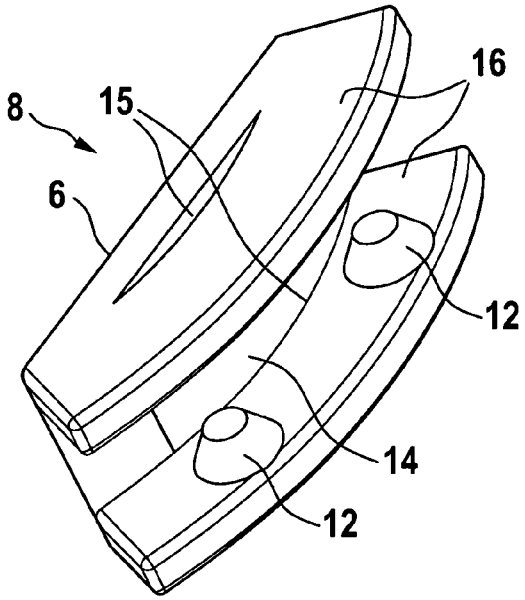

In the first variant, the rotational protection elements 8 are injection molded on the metal carrier 3. FIG. 2, in which one of the rotational protection elements 8 is shown greatly enlarged and isolated from the metal carrier 3, is used for clarification. Here, retaining cones 12 can be seen, which are formed during the injection molding process due to complementary depressions 13 in the metal carrier 3 and which engage with these depressions in a positive fit. These depressions 13 are shown in FIG. 1 on the recess 10 corresponding with the rotational protection elements 8. It further follows from FIG. 2 that a rear side 14 of the flattened section 6 is also flat, while the recess 10 has cylindrical inner contours, so that between the rear side 14 and the recess 10 there is an air gap. In addition to the material properties of the plastic, through holes 15 in legs 16 of the rotational protection element 8, which has a U-shaped cross section, provide its high dimensional elasticity, so that the flattened sections 6 can yield elastically orthogonal to the longitudinal extent of the guide rail 1, in order to compensate for alignment errors of the flattened sections 6 relative to the key surfaces 7 of the valve tappet 2 in this direction.

Figure 3:
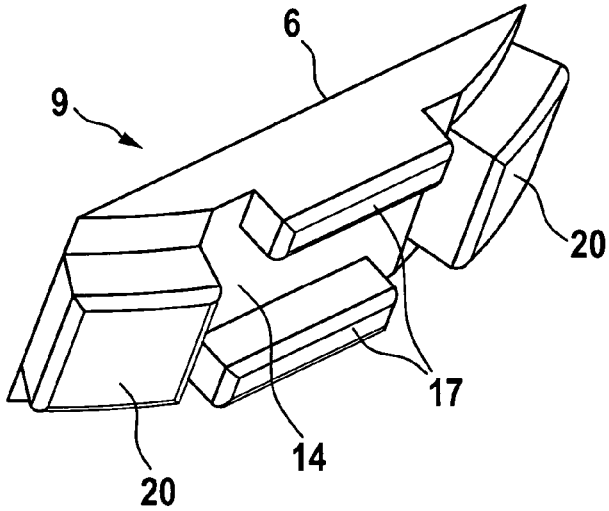

As an alternative to the injection-molded rotational protection elements 8, the rotational protection elements 9 are formed as injection-molded parts produced separately from the metal carrier 3 and fixed by means of a clamping connection on the metal carrier 3. One of the rotational protection elements 9 is shown, also greatly enlarged, in FIG. 3 as a detail before installation on the metal carrier 3. Clearly visible are ribs 17, which extend on the rear side 14 of the flattened section 6 and which surround a top side 18 and a bottom side 19 of the metal carrier 3 for fixing each rotational protection element 9 in the lifting direction of the valve tappet 2. The rotational protection element 9 further has clamping pieces 20, which are formed on both sides of the ribs 17 and which interact with complementary formations 21 of the corresponding recess 11 of the metal carrier 3 according to FIG. 1, so that the rotational protection element 9 is also protected against rotation within the recess 11. In agreement with the first variant, in the rotational protection element 9, the rear side 14 of the flattened section 6 is also flat, while the recess 11 has cylindrical inner contours between the formations 21. In this respect, the flattened section 6 of the rotational protection element 9 can also be displaced between the rear side 14 and the inner contours of the recess 11 under elastic deformation in the direction of the air gap.

Figure 5:
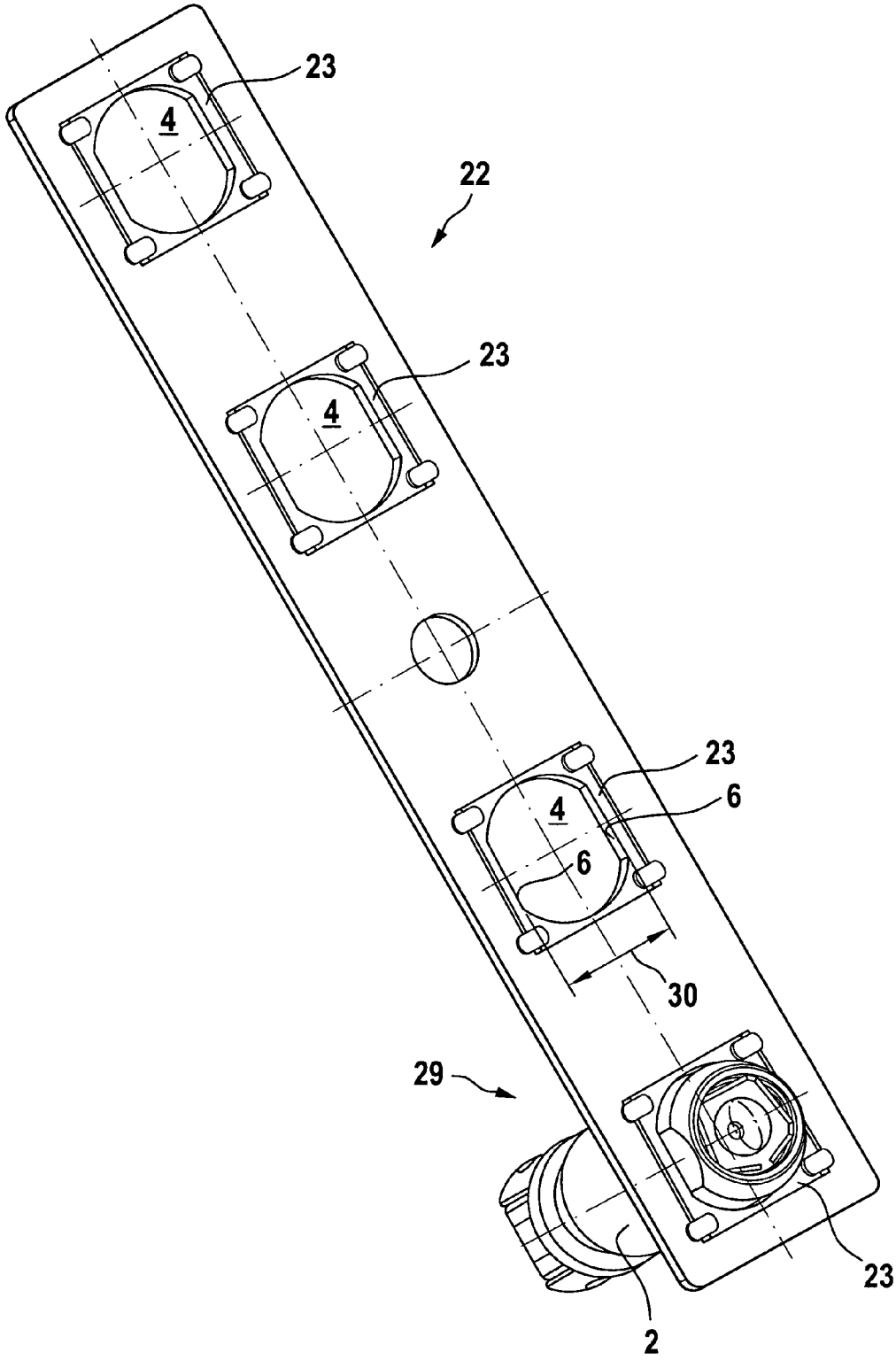
Figure 6:
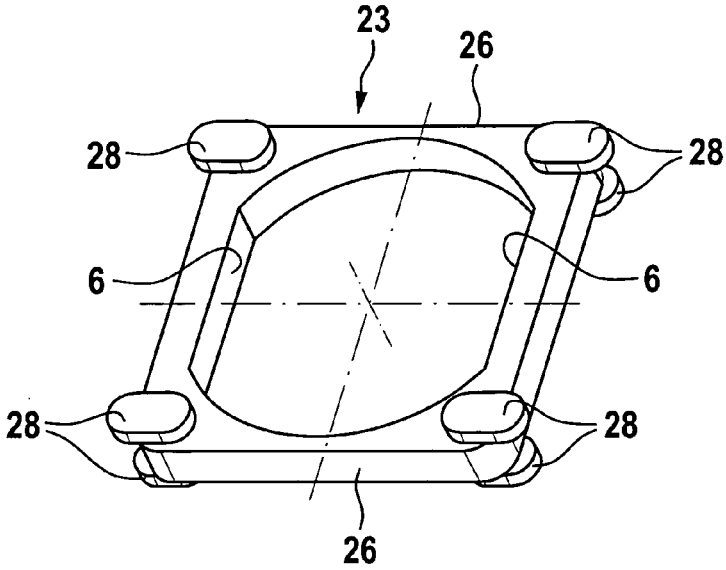
Figure 7:
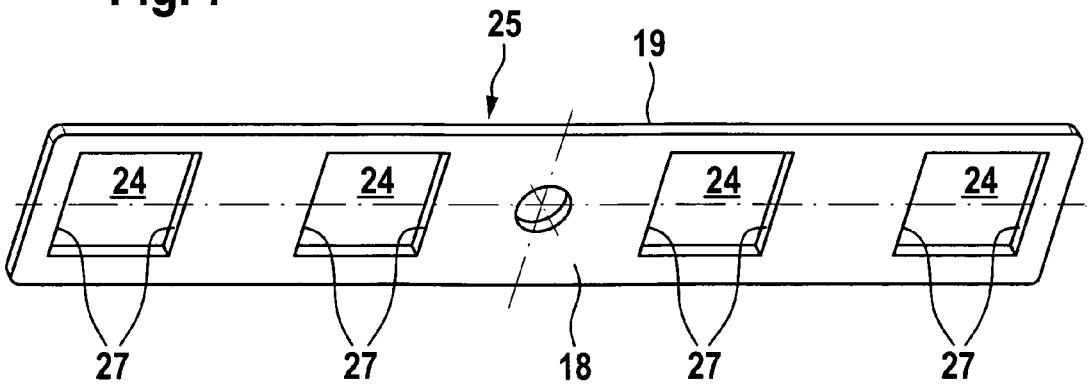

Another variant of a guide rail 22 is shown in FIG. 5. Here, rotational protection elements 23 forming the receptacle spaces 4 are mounted floating in recesses 24 of a metal carrier 25, with the flattened sections 6 being displaceable in common. As also visible from FIGS. 6 and 7, in which one of the rotational protection elements 23 is greatly enlarged and the associated metal carrier 25 is shown, respectively, the rotational protection elements 23 have a frame-like shape and sliding surfaces 26, which are mounted in guide surfaces 27 of the recesses 24 movable in the longitudinal direction and essentially free from rotational play. Here, the guide surfaces 27 and the sliding surfaces 26 extend orthogonal to the flattened sections 6. Clips 28, which are shown in principle in FIG. 6 and which surround the top side 18 and the bottom side 19 of the metal carrier 25 in the form of a snap-on connection, are used for fixing the rotational protection elements 23 on the metal carrier 25 in the lifting direction of the valve tappet 2.

Finally, as also provided in the previously described variants, the guide rail 22 forms one structural unit 29 that can be installed into the internal combustion engine in common with the valve tappets 2, with the receptacle spaces 4 being used both for guidance and also for holding the valve tappet 2 so that it cannot be lost during transport and installation of the structural unit 29.

For this purpose, an inner spacing 30 of the flattened sections 6 is dimensioned so that the key surfaces 7 of the valve tappet 2 engage without play, so that the resulting friction forces between the flattened sections 6 and the key surfaces 7 effectively prevent the valve tappet 2 from falling out of the guide rail 22. Depending on the material that is used for the rotational protection elements 23, it is useful to shape the inner spacing 30 of the flattened sections 6 for not yet installed valve tappets 2 somewhat smaller than an outer spacing 31 of the key surfaces 7 (FIG. 4), in order to always hold the valve tappet 2 in a way that prevents loss with slightly tensioned flattened sections 6.

LIST OF REFERENCE SYMBOLS

1 Guide rail
2 Valve tappet
3 Metal carrier
4 Receptacle space
5 Roller
6 Flattened section
7 Key surface
8 Rotational protection element
9 Rotational protection element
10 Recess
11 Recess
12 Retaining cone
13 Depression
14 Rear side
15 Through hole
16 Leg
17 Rib
18 Top side
19 Bottom side
20 Clamping piece
21 Formation
22 Guide rail
23 Rotational protection element
24 Recess
25 Metal carrier
26 Sliding surface
27 Guide surface
28 Clip
29 Structural unit
30 Inner spacing
31 Outer spacing

The invention claimed is:

1. A guide rail (1, 22) for guiding cylindrical valve tappets (2) of an internal combustion engine, with the guide rail (1, 22) having receptacle spaces (4), which are arranged at intervals over a longitudinal extent thereof, which are each used for receiving one of the valve tappets (2), and in which there are flattened sections (6) that are spaced apart in parallel and that interact in a positive fit with key surfaces (7) of the valve tappets (2), such that the valve tappets (2) are protected from rotating about respective longitudinal axes, with the flattened sections (6) permitting alignment of the valve tappets (2) orthogonal to the respective longitudinal axes and parallel to the flattened sections (6), the guide rail (1, 22) comprises a metal carrier (3, 25) and rotational protection elements (8, 9, 23), which are fixed in recesses (10, 11, 24) of the metal carrier (3, 25), which have the flattened sections (6), and which also permit alignment of each of the valve tappets (2) orthogonal to the respective longitudinal axis and orthogonal to the flattened sections (6), in that each of the flattened sections (6) belonging to one of the receptacle spaces (4) can be displaced individually or in common orthogonal to the flattened sections (6) relative to the metal carrier (3, 25).

2. The guide rail according to claim 1, wherein the rotational protection elements (8, 9, 23) are dimensionally elastic.

3. The guide rail according to claim 2, wherein an inner spacing (30) of the flattened sections (6) is dimensioned so that the flattened sections surround the key surfaces (7) of the associated valve tappet (2) without play, with the guide rail (1, 22) forming a structural unit (29) protected from loss in common with the valve tappets (2) held in the receptacle spaces (4).

4. The guide rail according to claim 1, wherein an air gap is formed between rear sides (14) of the flattened sections (6) and the recesses (10, 11, 24) of the metal carrier (3, 25).

5. The guide rail according to claim 4, wherein each of the receptacle spaces (4) is allocated precisely to one rotational protection element (23), with the rotational protection element (23) being mounted floating in the corresponding recess (24) of the metal carrier (25) in a direction orthogonal to the flattened sections (6).

6. The guide rail according to claim 5, wherein the rotational protection elements (23) have a frame-like shape and sliding surfaces (26) arranged so that the rotational protection elements can move longitudinally from guide surfaces (27) in the recesses (24) of the metal carrier (25), with the guide surfaces (27) and the sliding surfaces (26) extending orthogonal to the flattened sections (6).

7. The guide rail according to claim 1, wherein the rotational protection elements (8, 9, 23) are comprised of glass fiber-reinforced plastic.

8. The guide rail according to claim 7, wherein the rotational protection elements (9, 23) are fixed on the metal carrier (3, 25) by a clamping or snap-on connection as injection-molded parts produced separately from the metal carrier (3, 25).

9. The guide rail according to claim 7, wherein the rotational protection elements (8) are injection molded on the metal carrier (3).

10. The guide rail according to claim 1, wherein the metal carrier (3, 25) is produced as a stamped part.

* * * * *